US007950507B2

(12) United States Patent
Figueras Mitjans

(10) Patent No.: US 7,950,507 B2
(45) Date of Patent: May 31, 2011

(54) DAMPING MECHANISM FOR FOLDING SEATS IN CHAIRS

(75) Inventor: Jose Figueras Mitjans, Lliça D'Amunt (ES)

(73) Assignee: Figueras International Seating, S.L., Barcelona (ES)

( * ) Notice: Subject to any disclaimer, the term of this patent is extended or adjusted under 35 U.S.C. 154(b) by 0 days.

(21) Appl. No.: 12/842,117

(22) Filed: Jul. 23, 2010

(65) Prior Publication Data

US 2011/0024246 A1 Feb. 3, 2011

(30) Foreign Application Priority Data

Jul. 29, 2009 (ES) ..... 200901679

(51) Int. Cl.
*F16D 57/00* (2006.01)

(52) U.S. Cl. ..... 188/290; 297/332; 16/53

(58) Field of Classification Search ..... 188/290–298; 297/332; 16/53
See application file for complete search history.

(56) References Cited

U.S. PATENT DOCUMENTS

| | | | | |
|---|---|---|---|---|
| 5,165,507 | A * | 11/1992 | Ohshima | 188/290 |
| 5,257,852 | A * | 11/1993 | Tsuneki et al. | 297/332 |
| 5,291,630 | A * | 3/1994 | Brown | 16/53 |
| 5,465,817 | A * | 11/1995 | Muscatell | 188/295 |
| 6,442,795 | B1 * | 9/2002 | Chen | 16/53 |
| 2003/0009819 | A1 * | 1/2003 | Mizuno et al. | 4/248 |

* cited by examiner

*Primary Examiner* — Christopher P Schwartz
(74) *Attorney, Agent, or Firm* — Lucas & Mercanti, LLP

(57) ABSTRACT

The invention relates to a damping mechanism for folding seats in chairs, having an application in seats (1) incorporated in an articulated assembly by means of shafts (2), with springs (4) which act in the sense that they tilt the seat towards a vertical folded position, incorporating in each shaft (2) an eccentric cam (5) on which there is supported a damping piston which exerts retention action for smoothing the upward rotation of the seat by the action of the springs (4).

4 Claims, 6 Drawing Sheets

DAMPING MECHANISM FOR FOLDING SEATS IN CHAIRS

This Application claims the priority of Spanish Application No. P200901679, filed Jul. 29, 2009, the entire content of which is hereby incorporated by reference.

FIELD OF THE ART

The present invention relates to chairs with a folding structure which are arranged in places for accommodating large audiences of any type and which are generally distributed in parallel rows, proposing a device applicable in chairs of this type, with which the functional features of the tilting arrangement of the seat of the chair are improved.

STATE OF THE ART

In movie theaters, auditoriums, halls or sports stadiums, and similar enclosures, the arrangement of parallel rows of chairs for the attendees at the acts held in said enclosures to sit is common, this distribution achieving optimal use of space.

In this sense, for the purpose of facilitating the passage between the rows, for the users to get in and get out, as well as for cleaning operations, the chairs are generally structured with folding solutions of the seats thereof for the purpose of freeing up the space between the rows of chairs when they are not being used.

To that respect there are several articulated assembly solutions for the seats in chairs such that when the chair is taken by a user, the weight of the user keeps the seat of the chair in an lowered use position, whereas when the chair is not occupied, the seat automatically tilts to a vertical position against the backrest.

This solution achieves that when the chairs are not occupied, the seat thereof is automatically gathered in to the vertical position in which it does not invade the space in front of the chair, but the folding action of the seat, which is actuated by a spring, occurs abruptly, causing noise and, over time, misalignments of the structure of the chair, in addition to the risk of possibly hitting the users.

OBJECT OF THE INVENTION

According to the invention, a mechanism is proposed which allows solving in a simple manner the problem of folding the seats of the chairs so that the tilting occurs smoothly and without abruptly hitting against the end stop.

This device object of the invention consists of rotating shafts fixed to the tilting seat and on each shaft an eccentric cam which is arranged in an integrally rotating assembly on the corresponding shaft, supporting against said eccentric cam a damping piston of the type having a mobile rod the shifting of which is controlled by a viscous liquid which has to go through a narrow passage.

An arrangement is thus obtained with which, when the seat of the chair of application tilts, the rotational movement thereof is accompanied by the eccentric cams which are incorporated in the rotating shafts, forcing the rod of the corresponding damping pistons towards the inside of the damping piston when the tilting of the seat is from the horizontal use position towards the vertical folded position, and allowing the extension of the damping pistons when the tilting of the seat is from the vertical folded position towards the horizontal use position.

Thus, when the seat of the chair is not occupied in the horizontal use position, it tends to tilt rapidly towards the vertical folded position by the action of springs which act in this sense, but the relationship between the eccentric cam of the rotating shafts and the corresponding damping pistons causes a dampening of the movement, such that the tilting occurs smoothly, reaching the end stop without abruptly hitting it.

To take the seat from the vertical folded position towards the horizontal use position, it is only necessary to overcome the resistance of the springs which act towards the vertical position, the damping mechanism not exerting resistance in this sense, such that it does not make the operation difficult.

As a result, the proposed mechanism has very simple features for being carried out and applied, having its own identity and preferred character for the function of damping the tilting of the seats in chairs, compared to conventional mechanisms for this function.

DETAILED DESCRIPTION OF THE INVENTION

Figure 1:
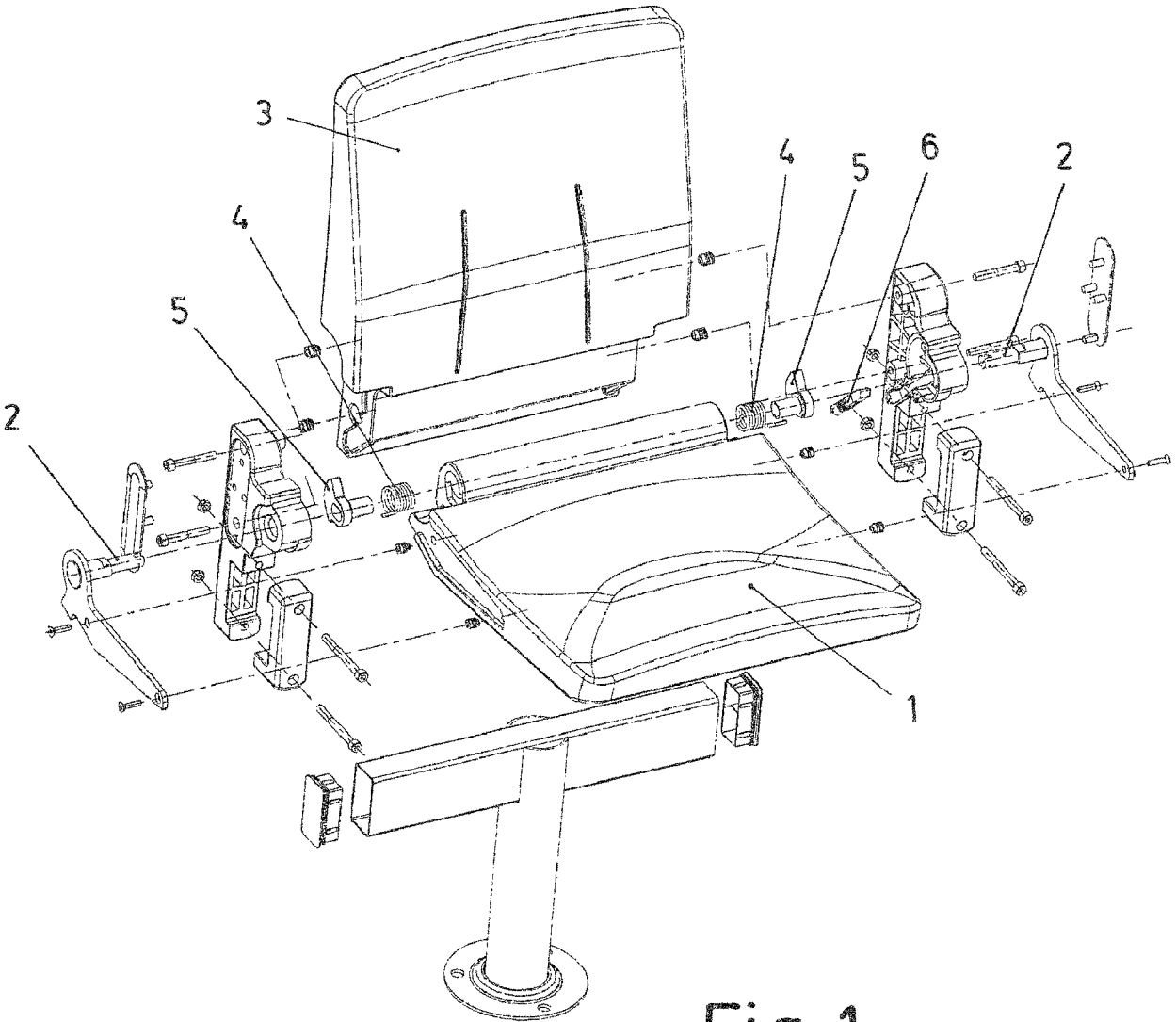
FIG. 1 shows an exploded perspective view of a chair with a tilting seat provided with the damping mechanism of the invention.
Figure 2:
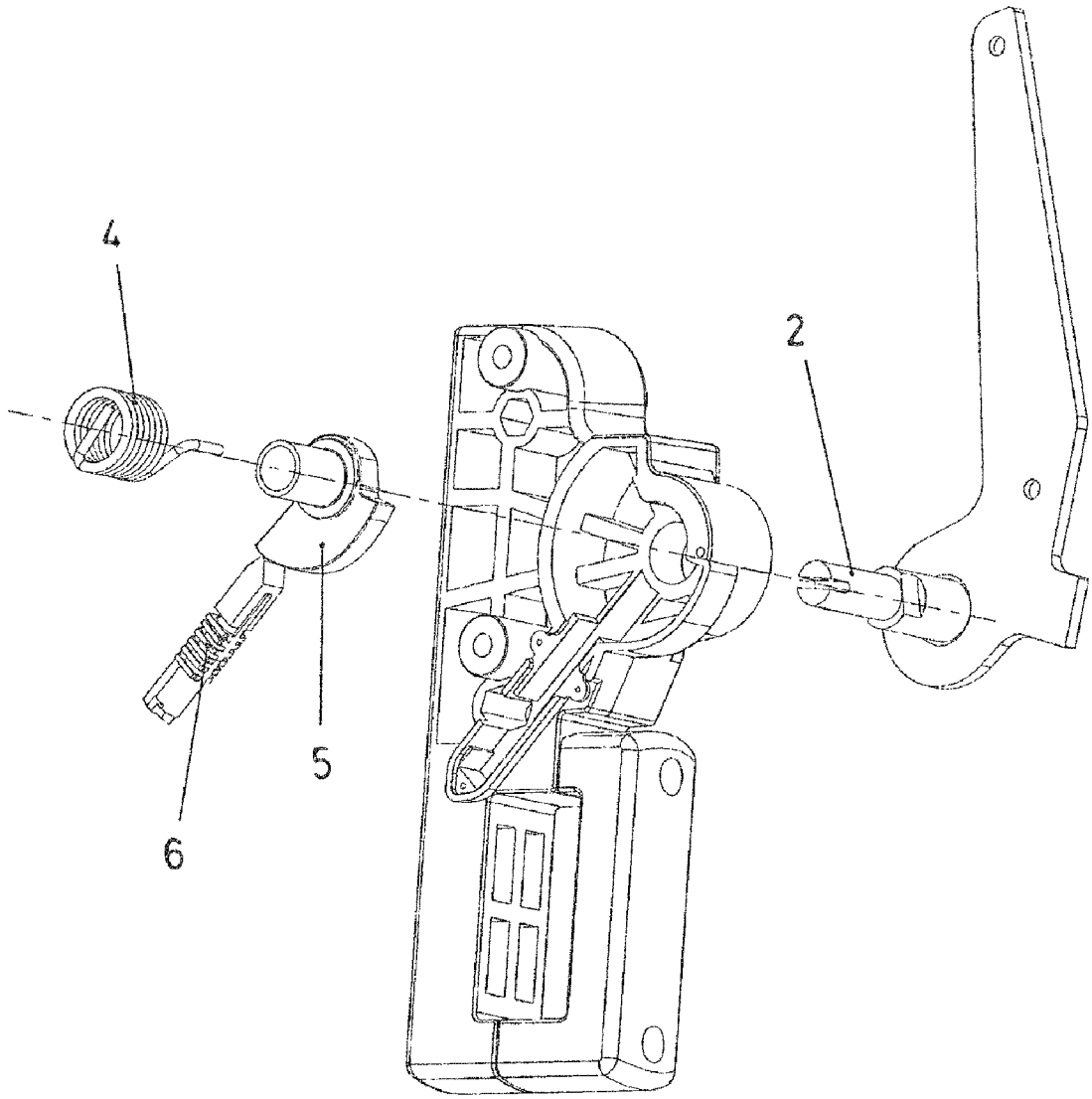
FIG. 2 shows an exploded perspective view of an enlarged detail of the damping mechanism of the invention in relation to a rotating shaft of the seat of a chair.
Figure 3:
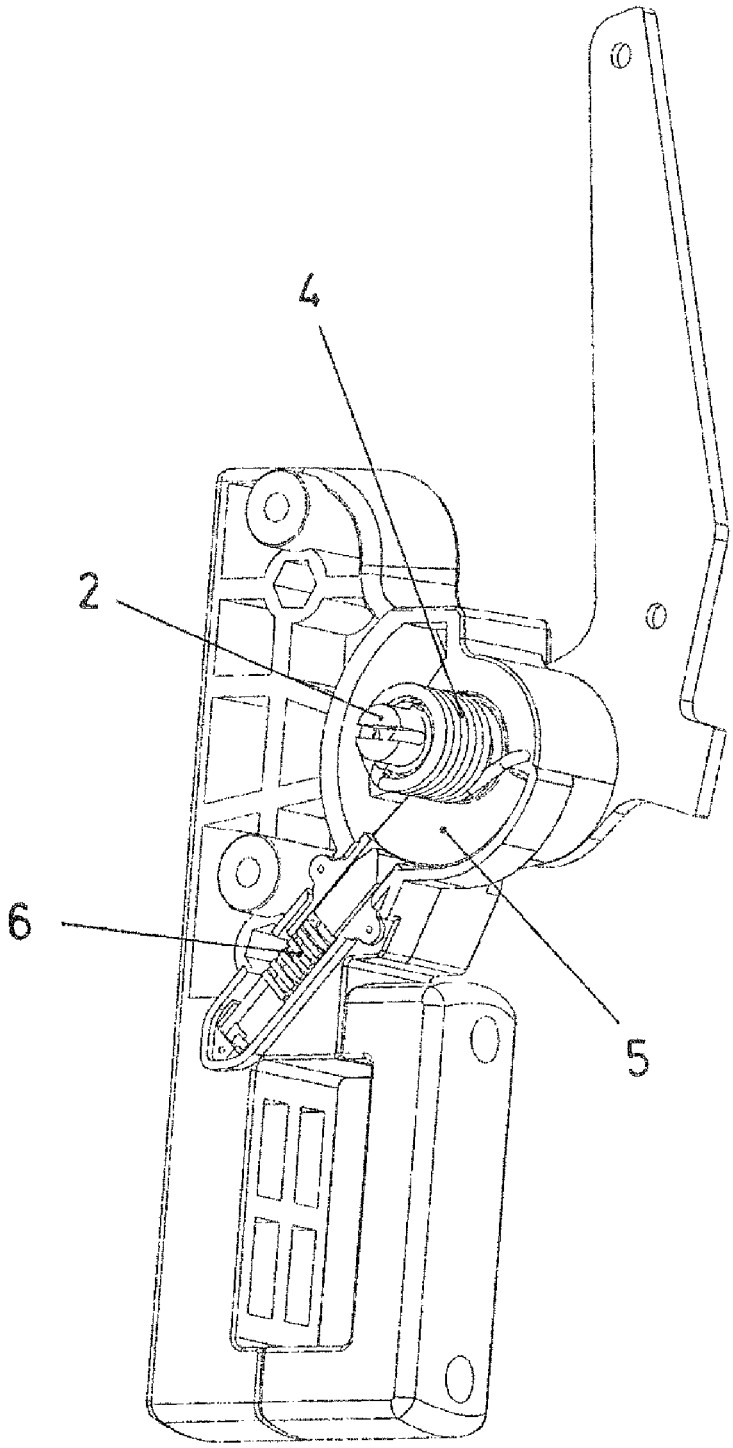
FIG. 3 is a perspective view of the assembly of the previous figure assembled, in the folded seat position.
Figure 4:
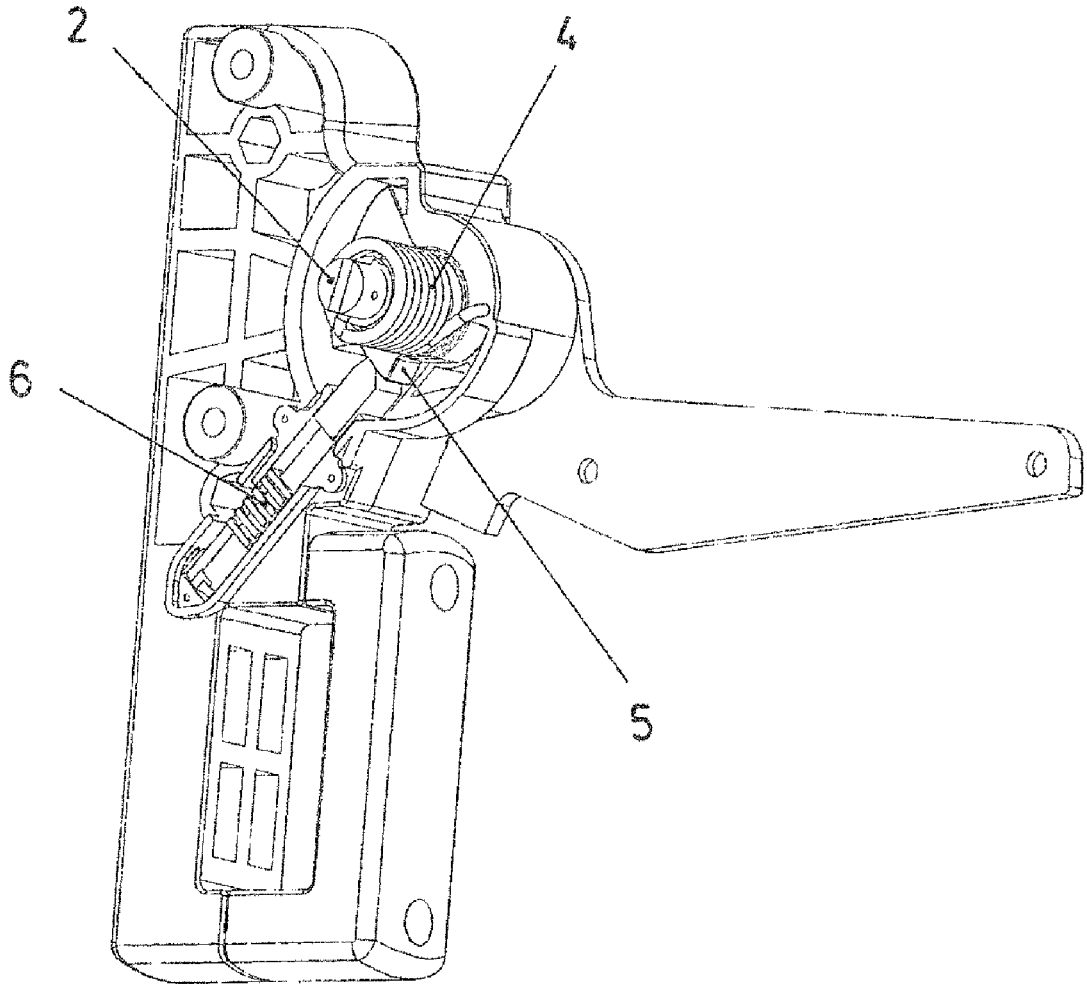
FIG. 4 is a perspective view of the same previous assembly in the use position of the seat.

The object of the invention relates to a damping mechanism, intended for smoothing the movement of tilting the seats in chairs towards the vertical folded position for the purpose of preventing said tilting seats from abruptly hitting against the corresponding backrest of the chair.

Said mechanism can be applied in chairs the seat (1) of which is arranged in an articulated assembly by means of rotating shafts (2), with the possibility of tilting between a horizontal use position and a vertical folded position against the corresponding backrest (3) of the chair, incorporating in relation to said articulated assembly springs (4) which act in the sense of lifting the seat (1) towards the vertical folded position.

The rotating shafts (2) are fixedly attached to the seat (1) and on each of them there is arranged an eccentric cam (5), incorporated such that it rotates integrally with the corresponding shaft (2), so that when tilting the seat (1) the shafts (2) rotate with it, in turn moving the eccentric cams (5) together in the same rotational movement.

In relation to the eccentric cams (5), there are arranged hydraulic damping pistons (6), i.e., they have a rod which can shift axially in movement controlled by a viscous liquid which has to pass through a narrow hole, supporting said damping pistons (6) radially against the outer surface of the respective eccentric cam (5).

Thus, when the seat (1) is in the vertical folded position, in order to lower it to the horizontal use position it must be forced against the action of the springs (4), rotating the eccentric cams (5) during this tilting in the sense of supporting them, from the part of larger radius towards the part of smaller radius, on the damping pistons (6), which allows said damping pistons (6) to be extended without exerting any influencing action on the tilting of the seat (1).

Figure 5:
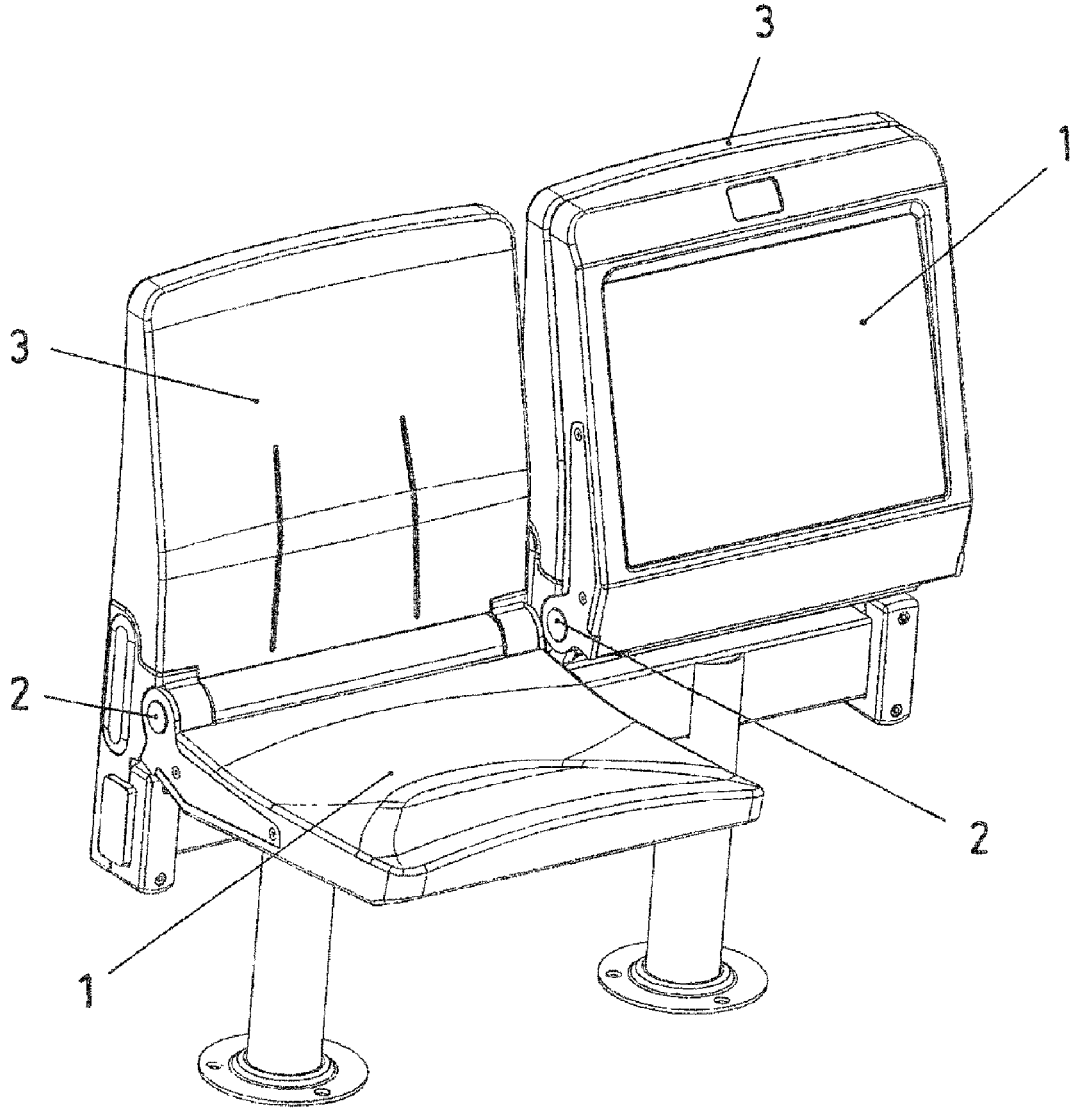
FIG. 5 shows an example of a module of two chairs with a folding seat, in which the damping mechanism of the invention is applicable.
Figure 6:
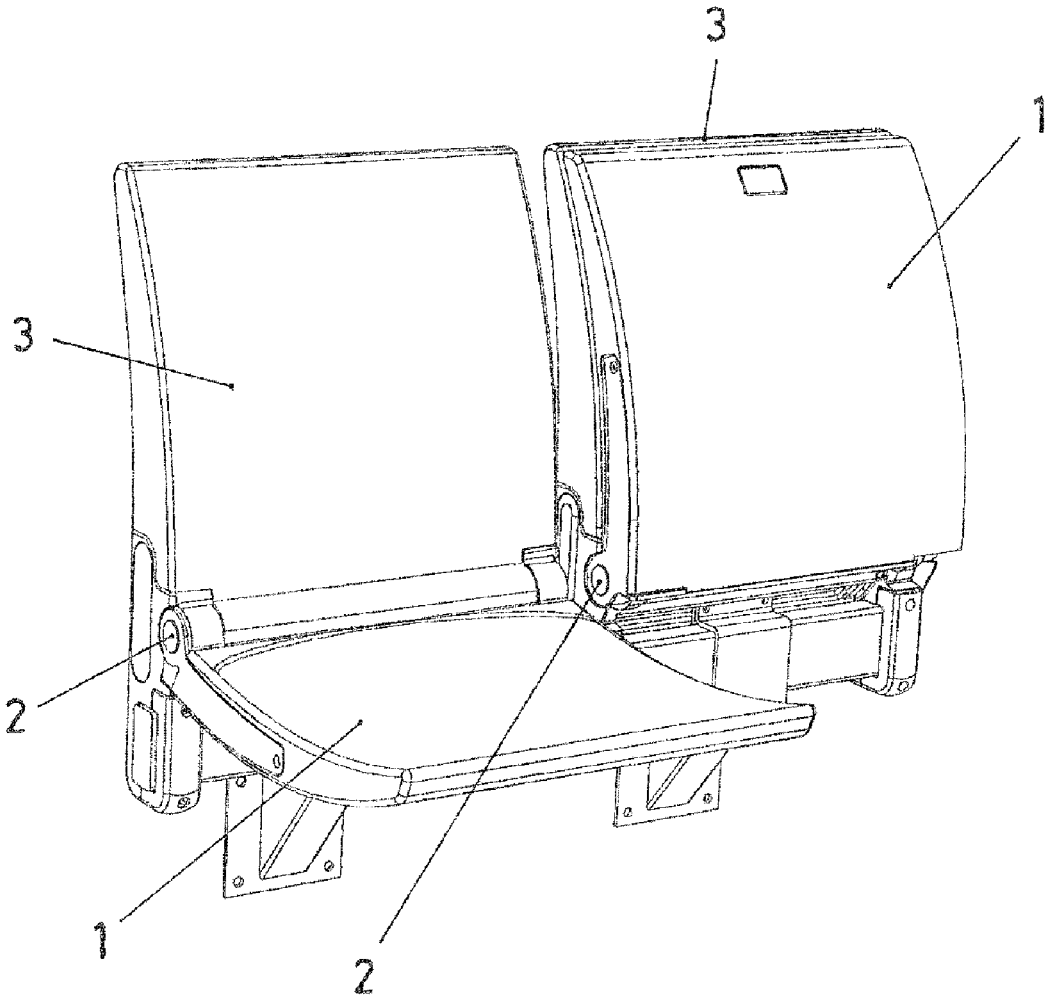
FIG. 6 shows another example of a module of two chairs with a folding seat, in which the damping mechanism of the invention is also applicable.

However, when the seat (1) is not occupied in the horizontal use position, when the user who was sitting gets up, said seat is actuated by the springs (4) towards the vertical position, tending to quickly tilt such that in the rotation, the periphery of the eccentric cams (5) travel in a supported manner, from the part of smaller radius towards the part of larger radius, on the damping pistons (6), forcing them to be drawn in, whereby causing a damping effect which smoothes the tilting speed due to the retention exerted by the damping pistons (6), since the hydraulic effect thereof forces their drawing in to be slow, whereby the seat (1) reaches the stop of the lifting, against the backrest (3), without The damping mechanism of the invention according to the described features can be applied in any chair with a tilting seat (1), such as those depicted in FIGS. 5 and 6, which are non-limiting examples.

The invention claimed is:

1. A damping mechanism for foldable seats arranged in an articulated assembly which are movable between a horizontal use position and a vertical folded position, comprising:

rotating shafts, which are each fixedly attached to the seat each rotating shaft having a spring arranged thereon which upwardly, radially tilts the seat towards the vertical folded position, wherein each rotating shaft has an eccentric radial cam with a variable radius rotating integrally with each shaft, and a damping piston supported on a periphery of the variable radius of the eccentric cam, the damping piston is arranged perpendicular to an axis of rotation of each shaft and exerts a retention action on the eccentric cam that smoothes the upward, radial tilting of the seat actuated by action of the springs.

2. The damping mechanism according to claim 1, wherein each eccentric cam travels in a supported manner from a part of a smaller radius towards a part of larger radius on the damping piston, causing a damping effect which smoothes the upward, radial tilting of the seat towards the vertical folded position.

3. The damping mechanism according to claim 1, wherein each damping piston is hydraulic.

4. The damping mechanism according to claim 1, wherein the spring is a torsion spring.

* * * * *